US005837971A

United States Patent [19]

Lee

[11] Patent Number: 5,837,971

[45] Date of Patent: Nov. 17, 1998

[54] ELECTRIC BLANKET HAVING REDUCED ELECTROMAGNETIC FIELD

[76] Inventor: Myoung Jun Lee, 16124 Rosecrans Ave., No. 16C, La Mirada, Calif. 90638

[21] Appl. No.: 785,981

[22] Filed: Jan. 21, 1997

[51] Int. Cl.[6] ..... H05B 1/00

[52] U.S. Cl. ..... 219/212; 219/528; 219/511

[58] Field of Search ..... 219/528, 529, 219/212, 511

[56] References Cited

U.S. PATENT DOCUMENTS

| | | | |
|---|---|---|---|
| 3,898,427 | 8/1975 | Levin | 219/522 |
| 4,281,237 | 7/1981 | Berenson | 219/212 |
| 4,885,456 | 12/1989 | Tanaka | 219/497 |
| 5,170,043 | 12/1992 | Gunnufson | 219/528 |
| 5,218,185 | 6/1993 | Gross | 219/528 |
| 5,465,013 | 11/1995 | Bassen | 219/528 |

*Primary Examiner*—Teresa J. Walberg
*Assistant Examiner*—Quan Nguyen

[57] ABSTRACT

An electric blanket using an AC to DC converter circuit either alone or in combination with a shield mesh that surrounds the heating wire to substantially reduce the electromagnetic field produced by the heating wire. The electric blanket has a heating element having a conductive wire and a shielding component, in which the conductive wire is placed between the shielding component to substantially encase the conductive wire. To discharge any build up of electrical charges, the shielding component is coupled to the ground. The electric blanket also has a control device for use with the alternating electrical current. The control device has a temperature control circuit that controls the current flow pursuant to the temperature setting. A converter device used in the electric blanket is electrically connected to the outputs of the control device. The converter device includes a rectifier circuit connected to the control device and has output terminals to generate rectified current from the alternating electrical current; and a filter circuit connected across the output terminals of the rectifier circuit to provide direct electrical current to the wire of the heating element. The output of the filter circuit is provided to the conductive wire to generate heat with substantially reduced electromagnetic field.

13 Claims, 4 Drawing Sheets

ELECTRIC BLANKET HAVING REDUCED ELECTROMAGNETIC FIELD

BACKGROUND OF THE INVENTION

1. Field of the Invention

This invention relates to electrically heated blankets, and more particularly to electrical blankets having reduced electromagnetic field.

2. Description of Related Art

It has been discovered that magnetic and electromagnetic fields affect biological matter and, consequently, cause health problems in human. Such health problems may be linked to cancer and other ailments. The electromagnetic fields are very common in modern society where consumer electric appliances are frequently used at homes and offices. Commonly, electromagnetic fields are generated by power lines and transformers. The electric blankets or pads which we use to keep warm also generate one or more forms of electromagnetic field. In fact, some studies have shown that there may be a direct correlation between electric blankets and certain medical conditions.

As it is well known that the electromagnetic field permeates through practically every kind of substances with the exception of ferromagnetic materials. Thus, attempting to block electromagnetic field in such appliances as electric blanket using ferromagnetic materials may not be practical due to its cost.

For example, FIG. 1 is a block diagram of a temperature controller and a heating element of a conventional electric blanket. The temperature controller 10 includes a bimetal thermostat switch 12 which can be set to appropriate temperatures to provide current to the heating element 20. Alternatively, as shown in FIG. 2, the temperature controller 10 may include an integrated circuit switch 14 instead of the thermostat switch 12 to provide the same function. The common characteristic of both FIGS. 1 and 2 is that the output voltage Vout at node 18 comprises a sinusoidal wave alternating current (AC). When using a conventional household line voltage, the Vout will be 60 Hz wave with peak voltage slightly higher than 120 V. The output voltage Vout is connected to the heating element 20. The heating element 20 is made with a resistive wiring 22 which produces heat when electricity is applied.

As described above, the resistive wiring 22 produces electromagnetic field which may be harmful to human when ordinary AC voltage is used as its input.

SUMMARY OF THE DISCLOSURE

It is an object of the present invention to provide an improved electric blanket or pad having reduced electromagnetic field, preferably by providing direct-current (DC) to the heating element. The electromagnetic field may be further reduced by shielding the heating element of the electric blanket.

According to an embodiment of the present invention, an electric blanket uses an AC to DC converter circuit either alone or in combination with a shield mesh that encases the heating wire to substantially reduce the electromagnetic field produced by the heating wire. In particular, the electric blanket has a heating element having a conductive wire and a shielding component, in which the conductive wire is substantially surrounded by the shielding component. To discharge any build up of electrical charges, the shielding component is coupled to the ground. The electric blanket also has a control device for use with the alternating electrical current. The control device has a temperature control circuit that controls the current flow pursuant to the temperature setting.

A converter device used in the electric blanket is electrically connected to the outputs of the control device. The converter device includes a rectifier circuit connected to the control device and has output terminals to generate rectified current from the alternating electrical current; and a filter circuit connected across the output terminals of the rectifier circuit to provide direct electrical current to the wire of the heating element. The output of the filter circuit is provided to the conductive wire to generate heat with substantially reduced electromagnetic field.

According to a further aspect of the present invention, the shielding component is in the form of a wire mesh made of copper wire. Preferably, the distance between each strand of copper wire in the wire mesh is about 5–10 mm. For improved flexibility and resiliency of the shielding component, the copper wire in the wire mesh is made of about 5 twisted individual copper wires. Alternatively, in lieu of the copper wires, the shielding component may be made of a fabric coated with a conductive material.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
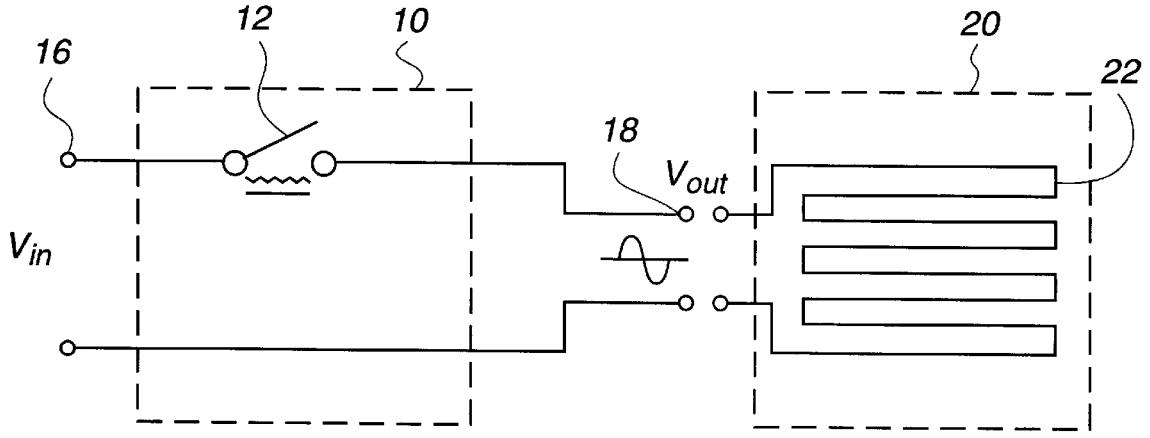
Fig. 1 (Prior Art)
FIG. 1 illustrates a block diagram of a prior art electric blanket.
Figure 2:
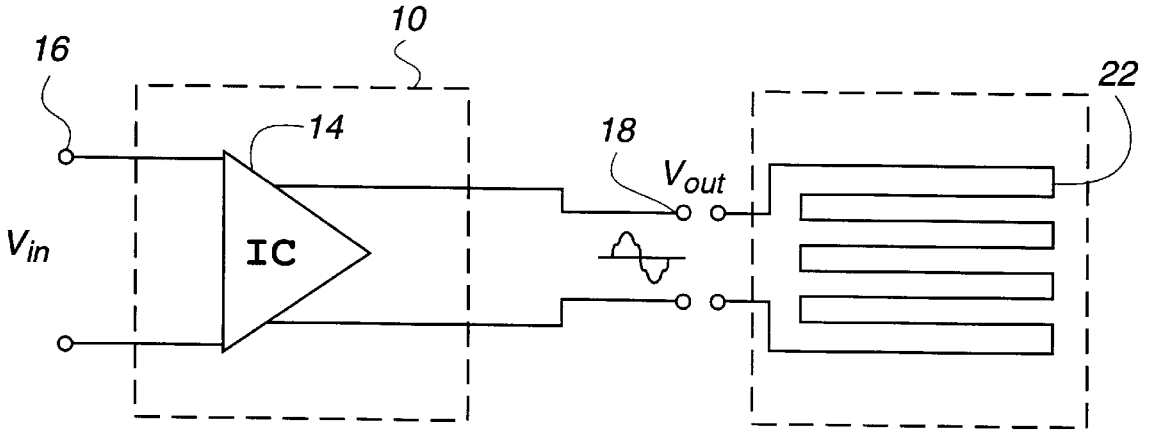
Fig. 2 (Prior Art)
FIG. 2 illustrates a block diagram of a prior art electric blanket using a different type of temperature controller.
Figure 3:
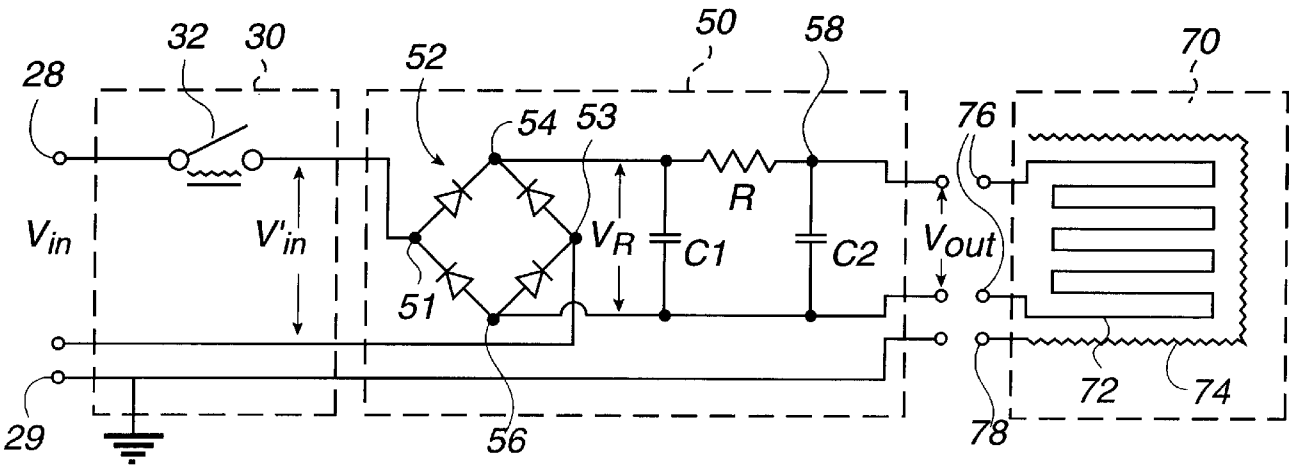
FIG. 3 illustrates a block diagram of a first embodiment of the present invention.

An electric blanket having reduced electromagnetic field according to an embodiment of the present invention is shown in the drawings for purposes of illustration. FIG. 3 shows a block diagram of the temperature controller 30, electromagnetic field suppressing device 50 and heating element 70 according to a preferred embodiment of the present invention. The temperature controller 30 is well known in the art and is provided to control the voltage between terminals 51 and 53 (denoted as V'in) with a thermal switch 32. The thermal switch 32 is designed and configured for a variable temperature setting by a user. The thermal switch 32 is preferably made of a bimetal, which is a laminate of two dissimilar metals having different coefficients of thermal expansion bonded together.

Figure 6A:
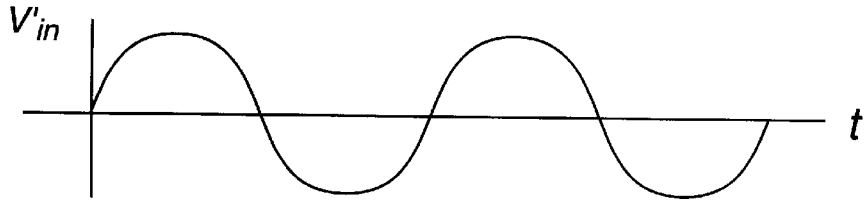
FIGS. 6A illustrates a voltage vs. time waveform of unrectified signal.
Figure 6B:
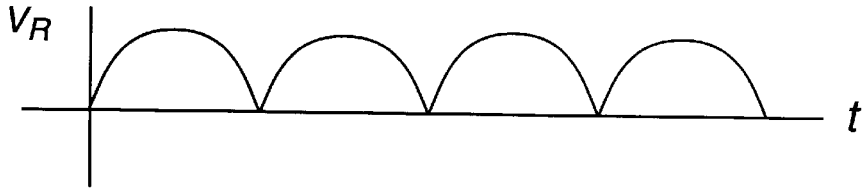
FIGS. 6B illustrates a voltage vs. time waveform of rectified signal.

The output voltage from the temperature controller 30 (V'in), which is a sinusoidal wave shown in FIG. 6A, is provided to inputs 51 and 53 of a full-wave rectifier 52 comprising four diodes forming a ring as shown in FIG. 3. In the preferred embodiment, a suitable full-wave rectifier 52 should be chosen to withstand a peak voltage in excess of the input line voltage Vin at node 28. The purpose of the full-wave rectifier 52 is to carry out AC to DC conversion for the purpose of supplying a constant voltage to the heating element 70. The output voltage $V_R$ at nodes 54 and 56 of the full-wave rectifier is illustrated in FIG. 6B. As an alternative embodiment of the present invention, a half-wave rectifier may be used in lieu of the full-wave rectifier 52. In the preferred embodiment, each diode of the full-wave rectifier 52 has a minimum operating range of about 3 amps and 250 to 400 volts, but other suitable diodes or the like may be used.

Figure 6C:
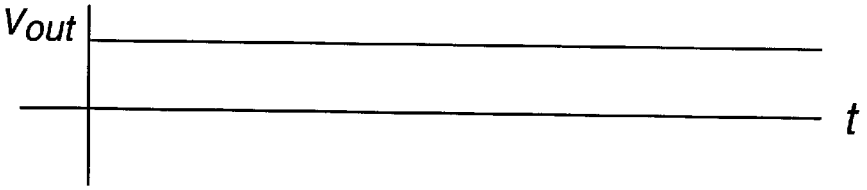
FIGS. 6C illustrates a voltage vs. time waveform of filtered or regulated signal.

After converting the AC to DC using the full-wave rectifier 52, the next step involves an energy-storage element to smooth out the time variations of the rectified waveform. This is achieved by capacitors C1 and C2 and R. Capacitance and resistance of suitable values may be used dependent upon the line voltage Vin and operating characteristics of the full-wave rectifier 52. For example, in the preferred embodiment, for a line voltage Vin of 120 V (which is a common household line voltage), the value of C1 and C2 may be about 100–200 $\mu$F and R may be about 2–5 ohms at 10 watts, but other suitable values can be used. More sophisticated filter circuits do better jobs of smoothing than capacitors. Alternatively, a regulator circuit (not shown) may be used in lieu of the resistor R for additional smoothing and to steadily maintain the DC voltage level despite variations of current demanded by the load. The output voltage Vout from node 58 is illustrated in FIG. 6C.

The heating element 70 of the present invention includes a resistive wiring 72 which produces heat when electrical current is provided. The resistive wiring 72 may comprise a single strand conductive wire wound over a core or a positive temperature coefficient (PTC) plastic strip bonded to low resistance conductors connected to the power line. Although the use of direct-current as a power supply to the heating element 70 reduces the effect of electromagnetic field, to further reduce the electromagnetic field generated from the resistive wiring 72, a shield 74 may be used, as shown in FIG. 3. In particular, the shield 74 is made preferably with copper or other suitable materials to substantially block the electromagnetic field emitted from the resistive wiring 72.

Figure 5:
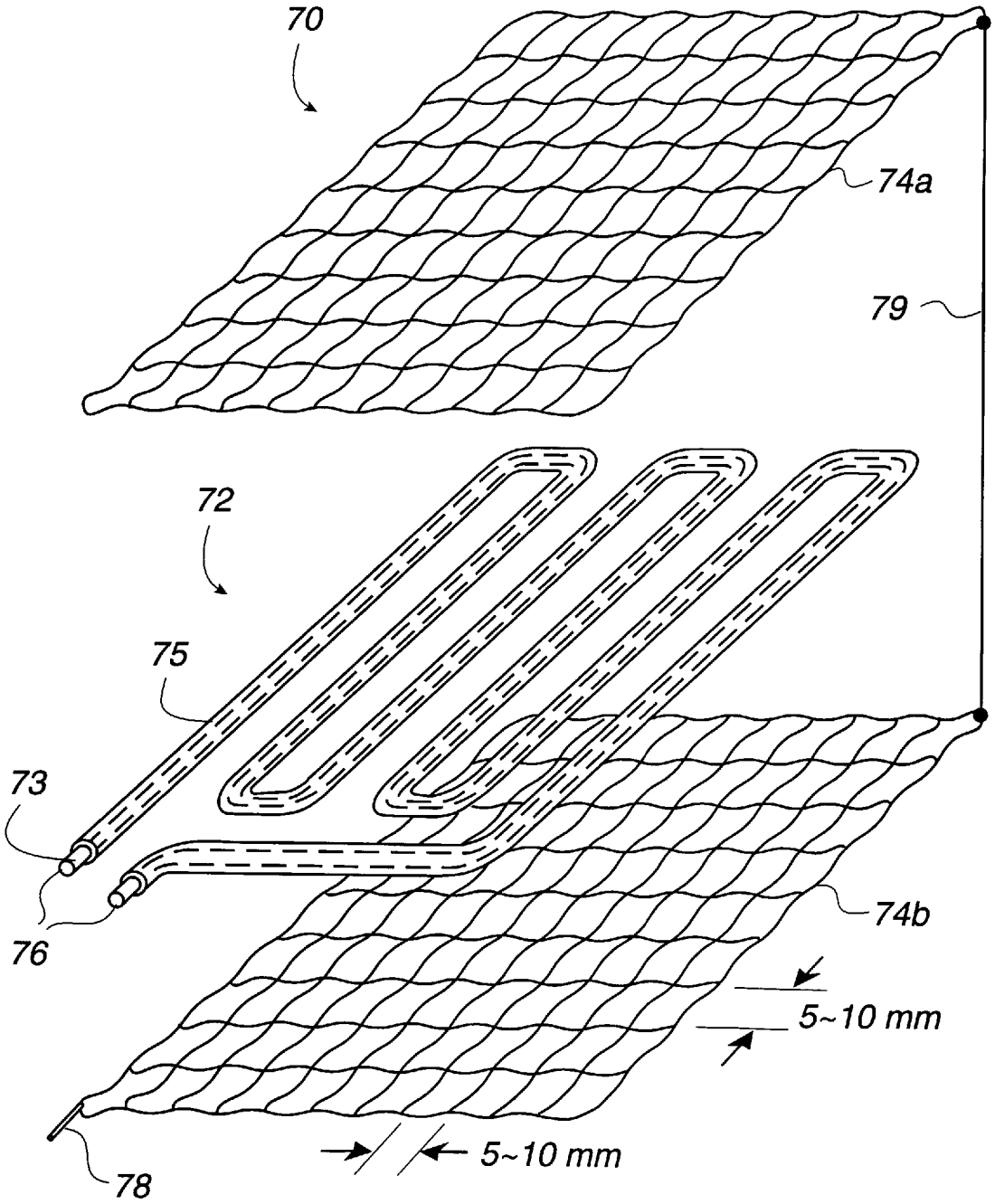
FIG. 5 illustrates an exploded view of the heating element with a shield according to an embodiment of the present invention.

FIG. 5 shows one type of resistive wiring 72 which includes a conductive wire 73 and an insulator 75. The shields 74*a* and 74*b*, which is preferably made with thin copper wires is webbed to form a substantially flat and flexible mesh. In the preferred embodiment, the conductive wire of the shields 74*a* and 74*b* consists of a multiple, such as five (5), strands of twisted conductive wires, each wire having a diameter of about 0.005 mm, for increased resiliency and flexibility. Two shields 74*a* and 74*b* are positioned so that the first shield 74*a* is preferably above and the second shield 74*b* is below the resistive wiring 72 to sandwich the resistive wiring 72 in between. The purpose of a connecting wire 79 is to illustrate that the first shield 74*a* and the second shield 74*b* are electrically connected to each other. Preferably, when the heating element 70 is constructed, the first and second shields 74*a* and 74*b* may be joined at the edges to form a fully conducting envelope where the resistive wiring 72 can be inserted. The terminal 78 is preferably connected to the ground terminal 29 to discharge any current build-up from electromagnetic field and/or static electricity. This way the possibility of electric shock by an exposed wire 73 is eliminated because the current carrying wire 73 cannot be exposed without it being short circuited by the shield 74*a* or 74*b*.

In the first and second shields 74*a* and 74*b*, the gap between each thread of wire may be adjusted dependent upon the frequency of the electromagnetic field generated from the resistive wiring 72. For example, if the present invention is used with 120 V line voltage at 60 Hz, then the gap between each wire should preferably be about 5 to 10 mm. In an alternative embodiment of the present invention, the shield 74 may be made of a flexible foil or a cloth sprayed or coated with a conductive material.

Figure 4:
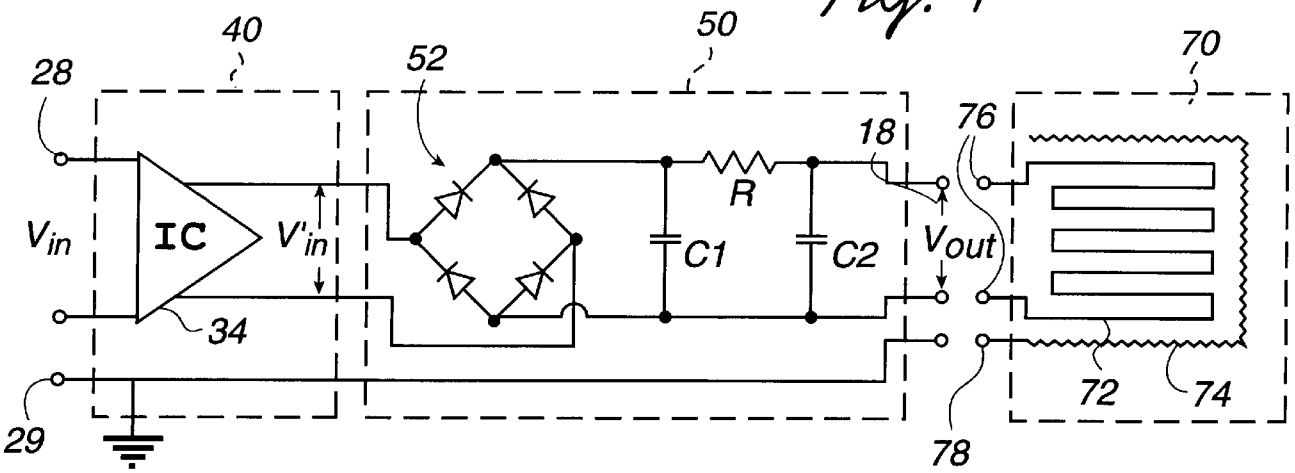
FIG. 4 illustrates a block diagram of a second embodiment of the present invention.

FIG. 4 shows an alternative embodiment of the present inventions, in which the same electromagnetic field suppressing device 50 and heating element 70 are being used with a temperature controller 40 equipped with an integrated circuit temperature controller rather than a bimetal type controller shown in FIG. 3.

As an alternative embodiment of the heating element 70, a coaxial type cable (not shown) may be used where the inner wire is connected to the power supply and an outer shield is connected to the grounded side of the ac power source. The outer shield preferably has a very low resistance compared to that of the inner wire. The possibility of electric shock by an exposed inner wire is eliminated by the use of the coaxial type cable because the current carrying inner wire cannot be exposed without it being short circuited by the outer shield which is connected to the ground. If the coaxial wire is used as the resistive wiring 72, the shields 74*a* and 74*b* may not be needed since the coaxial wire has a built-in shield surrounding the wire.

Figure 7:
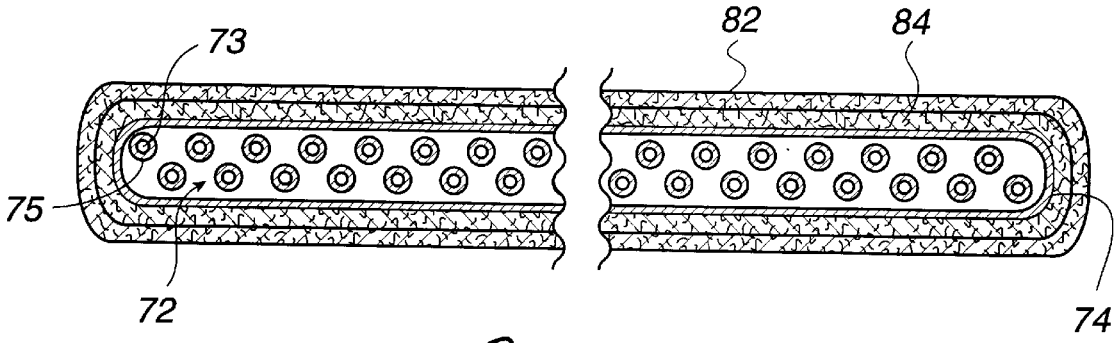
FIG. 7 illustrates a cross-sectional view of the heating element.

FIG. 7 shows a cross-sectional view of the heating element 70, in which the resistive wiring 72 is laid out in a zig-zag pattern (because FIG. 7 is a cross-sectional view, the zig-zag pattern of the resistive wiring 72 cannot be seen). Encasing the resistive wiring 72 is the shield 74. The shield 74 is then covered with a fabric material 84, such as cotton. The whole assembly may then be covered with a resilient fabric to form a blanket or a comforter.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electric blanket adapted for use with alternating electrical current and a ground, the electric blanket comprising:

a heating element having a conductor disposed and enclosed between a first planar shield mesh and a second planar shield mesh, the first and second planar shield meshes substantially aligned to form a blanket layer, wherein the conductor is arranged to planarly meander between the first and second planar shield meshes which are coupled to the ground;

a control device for use with the alternating electrical current, having a temperature control circuit for outputting the alternating electrical current in relation to a predetermined temperature setting; and a converter device electrically connected to the control device, wherein the converter device comprises a rectifier circuit connected to the control device and having output terminals to generate rectified current from the alternating electrical current; and a filter circuit connected across the output terminals of the rectifier circuit to provide direct electrical current to the conductor of the heating element.

2. An electric blanket of claim 1, wherein each one of the first and second planar shield meshes is in the form of a wire mesh made of conductive wire.

3. An electric blanket of claim 2, wherein the distance between each strand of the conductive wire in the wire mesh is about 5–10 mm.

4. An electric blanket of claim 2, wherein the conductive wire in the wire mesh is made of a plurality of twisted individual copper wires.

5. An electric blanket of claim 4, wherein the individual copper wire has a diameter of about 0.005 mm.

6. An electric blanket of claim 4, wherein the conductive wire in the wire mesh is made of five twisted individual copper wires.

7. An electric blanket of claim 1, wherein the filter circuit includes at least one capacitor connected to the output terminals of the rectifier circuit.

8. A resistive wiring for use in an electrical blanket adapted for use with a power source and a ground, the resistive wiring comprising:

a conductor which produces heat when connected to the power source; and a first planar shield mesh and a second planar shield mesh, the first and second planar shield meshes being substantially aligned to form a blanket layer, wherein the conductor is arranged to planarly meander between the first and second planar shield meshes.

9. A resistive wiring of claim 8, wherein each one of the first and second planar shield meshes is in the form of a wire mesh made of conductive wire.

10. A resistive wiring of claim 9, wherein the distance between each strand of the conductive wire in the wire mesh is about 5–10 mm.

11. A resistive wiring of claim 9, wherein the conductive wire in the wire mesh is made of a plurality of twisted individual copper wires.

12. A resistive wiring of claim 11, wherein the individual copper wire has a diameter of about 0.005 mm.

13. A resistive wiring of claim 11, wherein the conductive wire in the wire mesh is made of at least three twisted individual copper wires.

* * * * *